US006679674B1

(12) United States Patent
Branham

(10) Patent No.: US 6,679,674 B1
(45) Date of Patent: Jan. 20, 2004

(54) OFFSET CONNECTION FOR SKID STEER LOADER BOOM ASSEMBLY

(75) Inventor: Douglas G. Branham, Burnham, PA (US)

(73) Assignee: New Holland North America, Inc., New Holland, PA (US)

( * ) Notice: Subject to any disclaimer, the term of this patent is extended or adjusted under 35 U.S.C. 154(b) by 50 days.

(21) Appl. No.: 10/191,431

(22) Filed: Jul. 10, 2002

(51) Int. Cl.[7] ..... E02F 3/627
(52) U.S. Cl. ..... 414/686; 414/722
(58) Field of Search ..... 414/685, 686, 414/722; 403/162, 163

(56) References Cited

U.S. PATENT DOCUMENTS

| | | | | |
|---|---|---|---|---|
| 3,203,565 | A | | 8/1965 | Keskitalo |
| 4,629,350 | A | | 12/1986 | Siewert et al. |
| 4,997,303 | A | | 3/1991 | Xu et al. |
| 5,088,881 | A | * | 2/1992 | Ball et al. ..... 414/686 |
| 5,387,047 | A | | 2/1995 | Korpi |
| 5,562,398 | A | | 10/1996 | Knutson |
| 6,200,059 | B1 | | 3/2001 | Sawdon et al. |
| 2002/0021960 | A1 | | 2/2002 | Waggoner |

* cited by examiner

*Primary Examiner*—Donald W. Underwood
(74) *Attorney, Agent, or Firm*—John William Stader; Collin A. Webb

(57) ABSTRACT

An offset connection for a skid steer loader or other work vehicle having right and left boom assemblies, an implement connected to boom assemblies, and a body. An offset connection assembly is provided that includes (i) a seat member attached to one of the triangular plate member and the lower link member, the seat member having a first passage formed therethrough, and a seat formed therein, (ii) a hollow offset pin journaled within a hole in the other of the triangular plate and the link member, the offset pin having (a) a surface offset from a center of the pin constructed to engage the seat of the seat member at a selectable orientation, and (b) a second passage formed therethrough, and (iii) a fastener passing through the first and second passages and securely fastening the hollow offset pin and the seat member in the selectable orientation.

15 Claims, 3 Drawing Sheets

OFFSET CONNECTION FOR SKID STEER LOADER BOOM ASSEMBLY

FIELD OF THE INVENTION

The invention relates generally to an offset connection assembly for connecting links of a boom assembly of a work vehicle such as a skid steer loader. More particularly, the invention relates to an improved offset connection assembly that includes specially tapered offset pins for securing the lower links to the boom arms of the loader so that the offset pins correct for a shift in the position of the boom or cutting edge of a loader bucket or other like implement.

BACKGROUND OF THE INVENTION

In the art of manufacturing work vehicles such as skid steer loaders, tractors, etc., the vehicles are often constructed to have pivoting lift arms or booms attached at a proximal end to the body of the vehicle so that the lift arms or booms may lift or carry a work implement such as a bucket loader. As is conventionally known, the work implement is attached to distal ends of the lift arms or booms that are distant from a proximal end. Typically, each lift arm or boom is constructed from a plurality of members. For example, in a skid steer loader 1 (referred to as a "SSL") as shown in FIG. 1, each boom assembly 3 includes a lifting member or boom arm 5, an upper link member 7, and a lower link member 9. In each boom assembly 3, boom arm 5 is fixed at one end to triangular plate member 10. Link members 7, and 9 are pivotally connected at one end to triangular plate member 10, and pivotally connected at another end to cab 15 of the skid steer loader. A hydraulic boom cylinder (not shown) is disposed beneath each boom arm 5 and is likewise pivotally connected to the triangular member at one end and to the cab 15 at another end.

Lifting member or boom arm 5 is fixed at a proximal end to the triangular plate member 10 and at a distal end to the work implement 11. The upper link member 7 is pivotally connected at a proximal end to the triangular plate member and pivotally connected at a distal end to cab 15 of the SSL 1. The cab 15 provides a space for the operator to sit when operating the SSL 1. The lower link member 9 is pivotally connected at a proximal end to the triangular plate member 10 and at a distal end to the cab 15. Typically, a pivot pin (not shown) forms part of the attachment between the lower link member 9 and the triangular plate member 10.

However, the prior art boom assembly 3 has a drawback in that it is difficult to assemble the SSL 1 so that there is complete symmetry between right and left boom assemblies 3. Quite often, one boom assembly 3 is slightly shorter than the other so that the implement 11 is aligned with the ground G in a skewed manner as is shown in FIG. 1. The asymmetry between right and left boom assemblies 3 results is two effects: boom shift and cutting edge shift. It is noted that the degree of boom shift and cutting edge shift shown in FIG. 1 is exaggerated for the purpose of illustration and is not to be construed as a true visual representation of the degree of asymmetry between right and left boom assemblies.

Each lifting member or boom arm 5 pivots along with its respective triangular plate member 10, and when the boom assembly 3 is not in use the boom arm 5 is pivoted until it rests on a stop (not shown) on the body of the SSL 1. However, because of boom shift, which results from asymmetry between right and left boom assemblies 3, only one boom arm 5 typically rests properly on its respective stop when not in use and the other boom arm 5 either does not engage its respective stop or bounces against it. A problem occurs when both boom arms 5 do not rest properly on respective stops in that one or both boom assemblies 3 suffer unnecessary stress and are placed at risk of damage.

Cutting edge shift is another undesirable result of asymmetric booms. As shown in FIG. 1, the bucket loader work implement 11 has a cutting edge 13. When one boom assembly is longer than the other, the cutting edge 13 is skewed relative to the ground G. For example, as shown in FIG. 1, the left side boom assembly being longer than the right side boom assembly causes the left hand portion of the cutting edge to dip lower (i.e. closer to the ground) than the right hand portion of the cutting edge. In practice, the actual distance that the left hand portion of the cutting edge is closer to the ground than the right hand portion may only be, for example, about one inch. However, even such a small difference affects the quality of digging and/or scooping that can be performed by the bucket loader 11.

Therefore, there is a need for a mechanism for application to a work vehicle 1 that compensates for, or corrects asymmetry between right and left boom assemblies, thereby eliminating or minimizing the deleterious effects of boom shift and/or cutting edge shift.

It is therefore an object of the present invention to provide an improved connection assembly for connecting one of the link members attached to the body of the vehicle, e.g., the lower link member of a boom assembly of a work vehicle, to a triangular plate member of the boom assembly in order to relatively position the lower link member with respect to the triangular plate member so as to correct shift in the boom and to minimize cutting edge shift.

Accordingly, a further object of the present invention is to overcome the disadvantages of the prior art work vehicle boom assemblies by providing the boom assembly with an offset connection assembly for attaching a lower link member to a triangular plate member, wherein the attachment assembly can be assembled to correct shift in the boom and to minimize cutting edge shift.

Another object of the present invention is to provide a mechanism for correcting shift in the boom that is durable and reliable.

A still further object of the present invention is to provide a mechanism for correcting shift in the boom that is simple and cost effective to manufacture and assemble.

SUMMARY OF THE INVENTION

In accordance with the above objectives, the present invention provides a boom assembly for attachment to a work vehicle having a body. The assembly includes (a) a boom arm connected at one end to a triangular plate member; (b) a link member, pivotally connected at a first end to the triangular plate member and pivotally connectable at a second end to the body of the vehicle; and (c) an offset connection assembly. The offset connection assembly includes (i) a seat member attached to one of the triangular plate member and the lower link member, the seat member having a first passage formed therethrough, and a seat formed therein, (ii) a hollow offset pin journaled within a hole in the other of the triangular plate and the link member, the offset pin having (a) a surface offset from a center of the pin constructed to engage the seat of the seat member at a selectable orientation, and (b) a second passage formed therethrough, and (iii) a fastener passing through the first and second passages and securely fastening the hollow offset pin and the seat member in the selectable orientation.

In accordance with a still further embodiment, there is provided a work vehicle having right and left boom assemblies, an implement connected to boom assemblies, and a body. Each of the right and left boom assemblies includes (a) a boom arm connected at one end to a triangular plate member, and at another end to the implement; and (b) a link member, pivotally connected at a first end to the triangular plate member and pivotally connectable at a second end to the body of the vehicle. At least one of the boom assemblies further includes (c) an offset connection assembly. The offset connection assembly includes (i) a seat member attached to one of the triangular plate member and the link member, the seat member having a first passage formed therethrough, and a seat formed therein, (ii) a hollow offset pin journaled within a hole in the other of the triangular plate and the link member, the offset pin having (a) a surface offset from a center of the pin constructed to engage the seat of the seat member at a selectable orientation, and (b) a second passage formed therethrough, and (iii) a fastener passing through the first and second passages and securely fastening the hollow offset pin and the seat member in the selectable orientation.

In accordance with a still further embodiment, there is provided a work vehicle having right and left boom assemblies, an implement connected to boom assemblies, and a body. Each of the right and left boom assemblies includes (a) a boom arm connected at one end to a triangular plate member, and at another end to the implement; (b) a lower link member, pivotally connected at a first end to the triangular plate member and pivotally connected at a second end to the body of the vehicle; and (c) an upper link member, pivotally connected at a first end to the triangular plate member and pivotally connected at a second end to the body of the vehicle. At least one of the boom assemblies further includes (d) a connection assembly. The offset connection assembly includes (i) a seat member attached to one of the triangular plate member and the lower link member, the seat member having a first passage formed therethrough, and a seat formed therein, (ii) a hollow offset pin journaled within a hole in the other of the triangular plate and the link member, the offset pin having (a) a surface offset from a center of the pin constructed to engage the seat of the seat member at a selectable orientation, and (b) a second passage formed therethrough, and (iii) a fastener passing through the first and second passages and securely fastening the hollow offset pin and the seat member in the selectable orientation.

In preferred embodiments of the present invention, the surface of the offset pin is a tapered portion, and the seat of the seat member is constructed to engage the tapered portion.

In the work vehicle according to the present invention, each boom assembly preferably comprises an offset connection assembly.

In further preferred embodiments a hydraulic boom cylinder is provided for each boom assembly, pivotally connected at one end to the body of the vehicle and pivotally connected at another end to the triangular plate member.

In accordance with still further, preferred embodiments, the seat member is attached to the triangular plate member and the pin is journaled in the link member.

Further objects, features and advantages of the instant invention will become apparent from the Detailed Description of Preferred Embodiments, which follows, when considered together with the attached drawings.

DETAILED DESCRIPTION OF THE PREFERRED EMBODIMENTS

Figure 1:
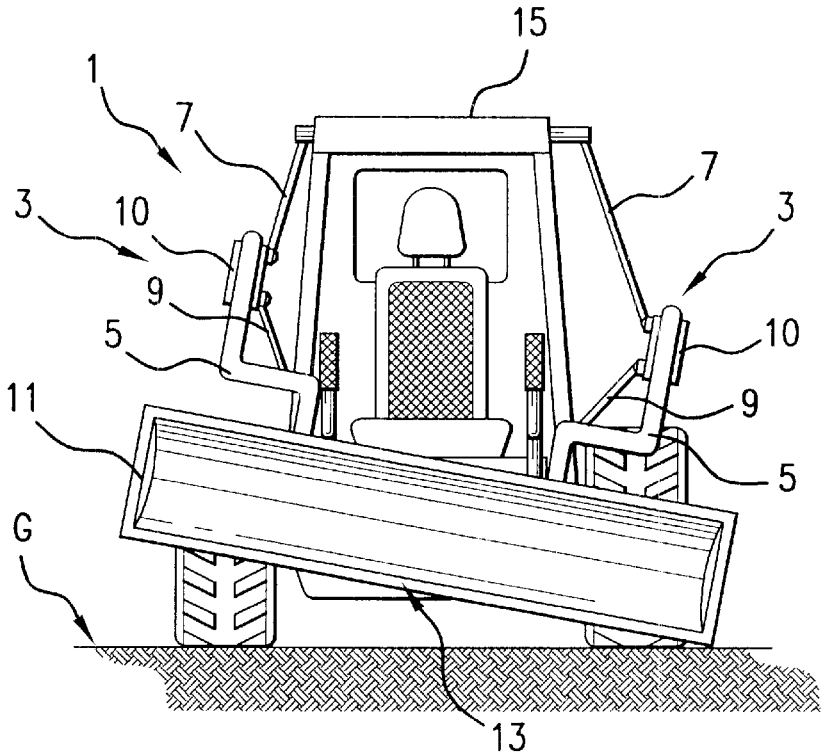
FIG.1 PRIOR ART
FIG. 1 is a front view of a prior art skid steer loader.
Figure 2:
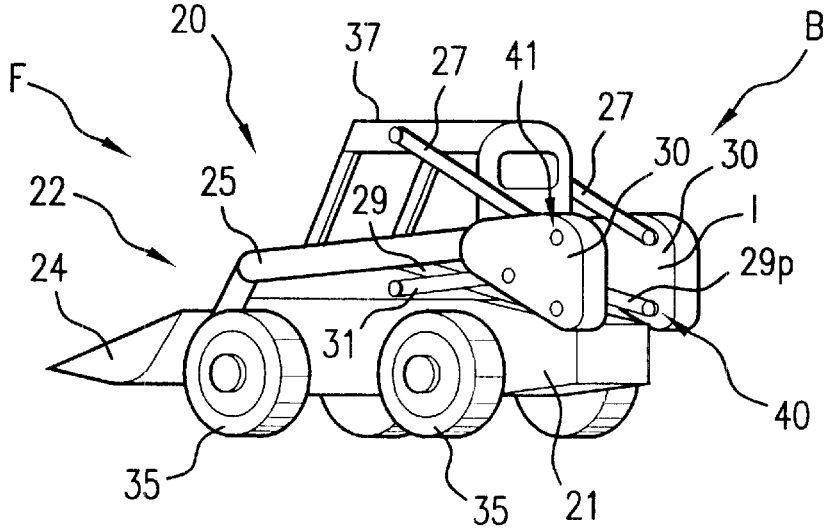
FIG. 2 is a rear perspective view of a work vehicle in accordance with a preferred embodiment of the present invention.

The apparatus of the present invention is a work vehicle 20 as shown in FIG. 2 that has right and left boom assemblies 22 connected in a conventional manner at a distal end to an implement 24, wherein each boom assembly 22 includes a lifting member or boom arm 25, an upper link member 27, and a lower link member 29. Each boom arm 25 is connected to a triangular plate member 30, and members 27 and 29 are pivotally connected to triangular plate member 30. Each triangular plate member 30 is preferably constructed from two triangular plates that are spaced apart from one another, although one skilled in the art would appreciate that other shapes, geometries, and constructions could be used without departing from the scope of the invention so long as the functionality of the apparatus is preserved. As is known in the art, a hydraulic boom cylinder 31 is pivotally connected at a proximal end to a respective triangular plate member 30 and pivotally connected at a distal end to cab 37 of work vehicle 20. When each boom cylinder 31 elongates due to hydraulic pressure, each respective boom assembly 22 is set in motion so that the triangular plate members 30 pivot about respective offset connection assemblies 40, 41 that connect the triangular plate members 30 to their respective upper and lower link members 27, 29. In this manner, each triangular plate member 30 moves and rotates to effect movement of the boom arms 25 and implement 24. Thus, the offset connection assembly 40 of the lower link member 29 serves as a fulcrum upon which the entire boom assembly 22 is lifted away from body 21 when desired.

Although work vehicle 20 has been illustrated as a skid steer loader or "SSL" for short, the present invention can be applied to any type of work vehicle that utilizes a pivoting lift arm or boom assembly that is prone to undesired shift during assembly or use. Likewise, although implement 24 has been illustrated as a bucket loader, other implements such as graders, plowing implements, etc., can be connected to the work vehicle 20 without departing from the spirit and scope of the present invention.

Preferably, work vehicle 20 is mobile and has wheels 35, although one skilled in the art would appreciate that the work vehicle 20 could be a tracked vehicle, positioned on rails, or even a stationary piece of mechanized equipment. Work vehicle 20 typically has its own motor (not shown) and has a cab 37, wherein an operator sits and operates the work vehicle 20 via various controls housed, for example, in the cab.

Each boom assembly 22 is constructed so that the lifting member or boom arm 25 is connected at a proximal end to the triangular plate member 30 and at a distal end to the work implement 24. The upper link member 27 is pivotally connected at a proximal end to the triangular plate member 30 and pivotally connected at a distal end to the cab 37 of the work vehicle 20. The cab provides a space wherein an operator positions himself or herself when operating the work vehicle 20 as is conventionally known. The lower link member 29 is pivotally connected at a proximal end 29*p* to the triangular plate member 30 and pivotally connected at a distal end to the cab 37.

Figure 3:
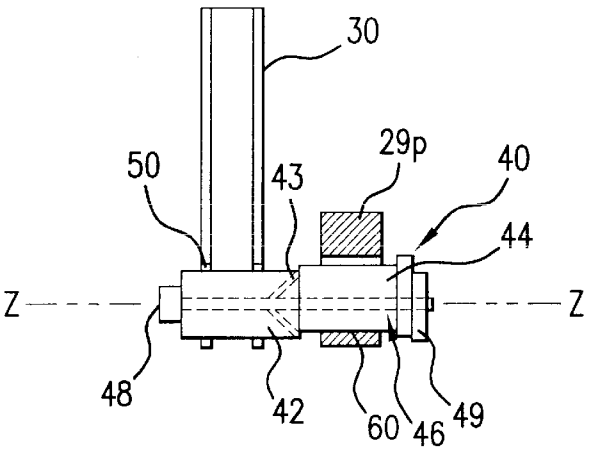
FIG. 3 is a cross sectional view of the connection assembly as it connects the lower link member to the triangular plate member in accordance with a preferred embodiment of the invention.

Offset connection assembly 40 is used to pivotally connect the proximal end 29*p* of the lower link member 29 to an inner surface I of the triangular plate member 30. Inner surface I is that surface of triangular plate member 30 that is closest to the cab 37. Offset connection assembly 40 may also be referred to as an attachment assembly. As shown in FIG. 3, offset connection assembly 40 includes seat member 42 that receives and engages offset pivot pin 44, and fastener 46 that is used to fasten and secure the connection assembly together. Seat member 42 is a hollow pin or bar that is fixed to or integral with the corresponding triangular plate member 30. Typically, seat member 42 is welded into a through hole portion 50 of the triangular plate member 30. Seat member 42 includes an inner bore or passage formed therein that widens into a concave engagement portion 43.

Figure 4B:
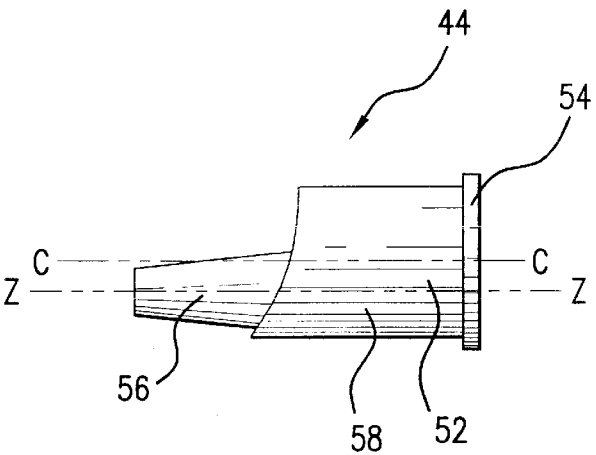
FIG. 4B is a side view of the pivot pin with the pivot pin oriented along the C axis.
Figure 4A:
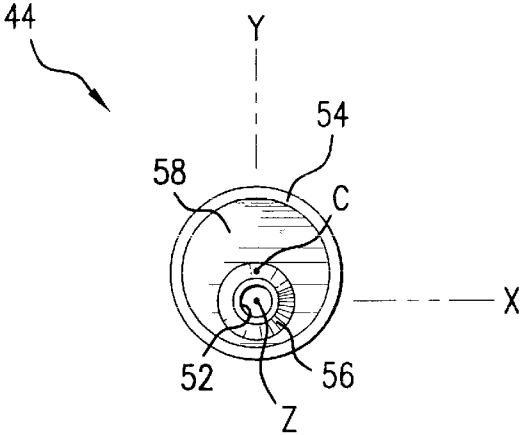
FIG. 4A is a front view of the pivot pin along the C axis where the tapered portion is disposed in the front end of the pivot pin.

Offset pivot pin 44 is a hollow pin or bar that includes an inner bore or passage 52 that is disposed off the central axis C of the pin 44. As shown in FIGS. 4A and 4B, central axis C of the pivot pin 44 is parallel to, but not coincident with, offset axis Z of the inner bore 52. Pivot pin 44 includes an end portion 54, a tapered portion 56, and a main body 58 disposed between the end portion and the tapered portion. The surface of the tapered portion 56 is provided and shaped to matingly engage the surface of the engagement portion 43 of the seat member 42 as will be described in more detail below. The main body 58 is provided, sized and shaped to fit into a through hole 60 in the proximal end 29*p* of the lower link member 29 so that the lower link member can pivot about the pivot pin 44.

When the connection assembly 40 is completely assembled, seat member 42 is attached to triangular plate member 30, pivot pin 44 is disposed in the through hole 60 of lower link member 29, and the fastener 46 is disposed in the inner bore of seat member 42 and in the inner bore of the pivot pin 44 so that fastener 46 securely positions the surface of the tapered portion 56 to fixedly engage the surface of the concave engagement portion 43 in a desired or selectable manner. Specifically, while the seat member 42, pivot pin 44, and fastener 46 are loosely assembled; it is possible to rotate the pivot pin 44 while the tapered portion 56 loosely engages the concave engagement portion 43. By rotating the pivot pin 44 in the engagement portion 43, it is possible to orient the body of pin 44 so that the lower link member 29 and triangular member 30 are displaced relative to one another. In this way, the pivot pin 44 can selectively position the boom arm 25 fore and aft for the adjustment of boom shift, or up and down for the adjustment of cutting edge shift. In other words, various selectable orientations are available when matingly engaging offset pin 44 into seat member 42. Once the correct orientation is selected, it is possible to fixedly secure the selected orientation so that the offset pin is held in position relative to the seat member by tightly securing the offset pin 44 to the seat member 42 with fastener 46.

Figure 5:
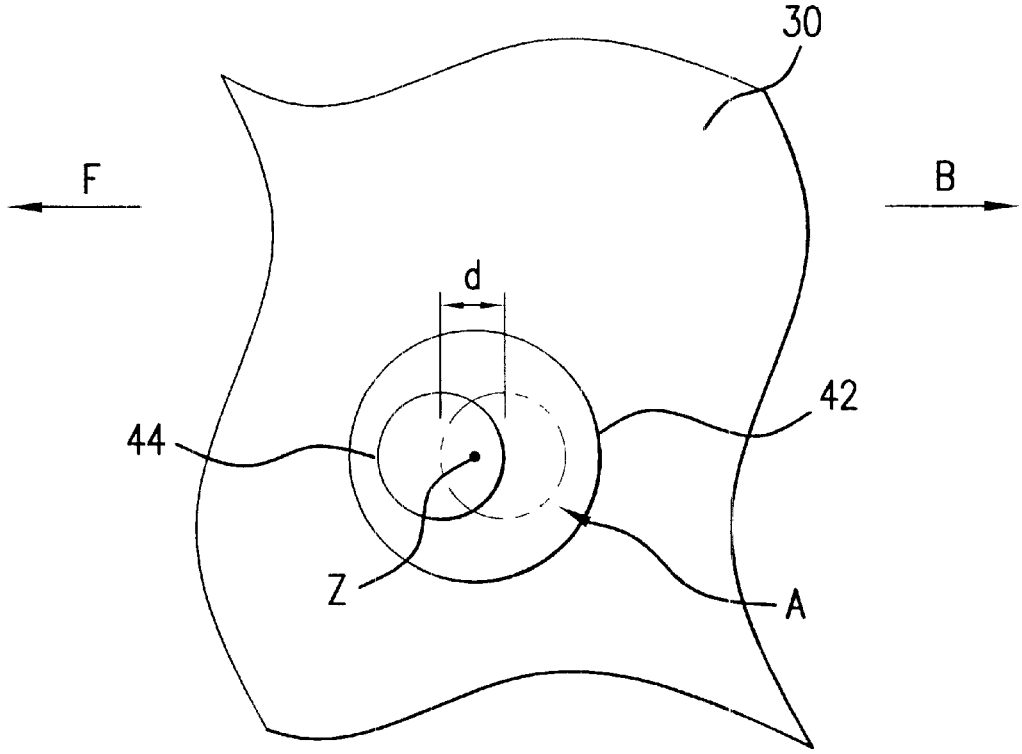
FIG. 5 is a cut away plan view of the pivot pin in the seat member (without the lower link member in place) to show various selectable orientations.

As would be appreciated by one skilled in the art, selectively orienting the offset pin 44 relative to the seat member 42 affects the position of the triangular plate member 30 relative to lower link member 29, which in turn either shores up or extends forwardly the respective boom arm 22. For example, when the pivot pin 44 is oriented with the body positioned towards the front end F as shown in FIG. 5, one skilled in the art would appreciate that the triangular plate member 30 would be displaced towards the front end F thereby causing the corresponding boom arm 22 to be extended in a slightly forward manner, which pushes the cutting edge of the implement 24 towards (i.e., closer to) the ground on the same side of the SSL 1. On the other hand, when the pivot pin 44 is oriented with the body positioned towards the rear end R, as shown by the shadow pin position A in FIG. 5, one skilled in the art would appreciate that the triangular plate member 30 would be displaced towards the rear end and cause the corresponding boom arm 22 to be shored up or pulled back in a slightly rearward manner, thereby pulling the cutting edge of the implement 24 away from the ground on the same side of SSL 1. Boom shift, as discussed above is a displacement of the boom arms 25 to the right or left when the boom assembly is in the powered down state, resting on the stops (not shown). Cutting edge shift, on the other hand is the displacement of one side of the cutting edge of the implement 24 up or down. In the typical case, because of the geometry of the boom assembly 22, a maladjusted boom assembly might exhibit some boom shift and some edge shift. The neutral position of the offset pin 44 would be in the up or twelve o'clock position.

As shown in FIG. 5, distance d is the maximum distance that can be used, or manipulated, to position the body 58 of pin 44 relative to the seat member 42. In other words, compared to a conventional straight pin, the connection assembly 40 which includes offset pivot pin 44 in accordance with the present invention can be used to extend the triangular plate member 30 forward a distance ranging from zero to d/2, or the pin 44 can be used to shore up or retract triangular plate member 30 backwards a distance ranging from zero to d/2. By extending the triangular plate member 30 forwards, or by retracting the triangular plate member 30 backwards, the relative position of the corresponding end of implement 24 can be pushed closer to, or pulled back away from, the ground.

One skilled in the art would understand that it is within the scope of the present invention to utilize an offset connection assembly 40 for securely attaching each one of the right and left lower link members 29 respectively to the right and left triangular plate members 30, or only one of the right and left lower link members may utilize the connection assembly 40 to provide a secure attachment to the corresponding one of the right and left triangular plate members 30. When only one of the right and left lower link members 29 is connected to the corresponding triangular plate member 30 using connection assembly 40, the other one of the right and left lower link members is connected to the corresponding leg member in the conventional fashion.

As stated above, when the boom assemblies are assembled, the pair of offset pins 44 for the right and left connection assemblies 40 are initially placed in the up or twelve o'clock position. If boom shift or cutting edge shift or a combination of the two is detected, then one or both of the offset pins are adjusted to eliminate the misalignment.

While the present invention has been described with reference to certain preferred embodiments, one of ordinary skill in the art will recognize that additions, deletions, substitutions, modifications and improvements can be made while remaining within the spirit and scope of the present invention as defined by the appended claims.

Specifically, the preferred embodiment shows a vehicle with two boom assemblies, whereas the invention is equally applicable to a vehicle having a single boom assembly. The preferred embodiment with two boom assemblies, shows the connection assembly connecting the lower link to the triangular plate member, whereas the connection assembly could just as well connect the upper link member to the triangular plate member. The preferred embodiment shows each seat member attached to the triangular plate member and the offset pin disposed through a hole in the link member, but this configuration can just as easily be reversed. Lastly, the vehicle with two boom assemblies could have either one or two connection assemblies.

What is claimed is:

1. A boom assembly for attachment to a work vehicle having a body, the assembly comprising:

(a) a boom arm connected at one end to a triangular plate member;

(b) a link member, pivotally connected at a first end to the triangular plate member and pivotally connectable at a second end to the body of the vehicle; and (c) an offset connection assembly including (i) a seat member attached to one of the triangular plate member and the lower link member, the seat member having a first passage formed therethrough, and a seat formed therein, (ii) a hollow offset pin journaled within a hole in the other of the triangular plate and the link member, the offset pin having (i) a surface offset from a center of the pin constructed to engage the seat of the seat member at a selectable orientation, and (ii) a second passage formed therethrough, and (iii) a fastener passing through the first and second passages and securely fastening the hollow offset pin and the seat member in the selectable orientation.

2. A work vehicle having right and left boom assemblies, an implement connected to boom assemblies, and a body, wherein each of the right and left boom assemblies comprises:

(a) a boom arm connected at one end to a triangular plate member, and at another end to the implement; and (b) a link member, pivotally connected at a first end to the triangular plate member and pivotally connectable at a second end to the body of the vehicle; and wherein at least one of the boom assemblies further comprises:

(c) an offset connection assembly including (i) a seat member attached to one of the triangular plate member and the link member, the seat member having a first passage formed therethrough, and a seat formed therein, (ii) a hollow offset pin journaled within a hole in the other of the triangular plate and the link member, the offset pin having (a) a surface offset from a center of the pin constructed to engage the seat of the seat member at a selectable orientation, and (b) a second passage formed therethrough, and (iii) a fastener passing through the first and second passages and securely fastening the hollow offset pin and the seat member in the selectable orientation.

3. A work vehicle having right and left boom assemblies, an implement connected to boom assemblies, and a body, wherein each of the right and left boom assemblies comprises:

(a) a boom arm connected at one end to a triangular plate member, and at another end to the implement;

(b) a lower link member, pivotally connected at a first end to the triangular plate member and pivotally connected at a second end to the body of the vehicle; and (c) an upper link member, pivotally connected at a first end to the triangular plate member and pivotally connected at a second end to the body of the vehicle; and wherein at least one of the boom assemblies further comprises:

(d) an offset connection assembly including (i) a seat member attached to one of the triangular plate member and the lower link member, the seat member having a first passage formed therethrough, and a seat formed therein, (ii) a hollow offset pin journaled within a hole in the other of the triangular plate and the link member, the offset pin having (a) a surface offset from a center of the pin constructed to engage the seat of the seat member at a selectable orientation, and (b) a second passage formed therethrough, and (iii) a fastener passing through the first and second passages and securely fastening the hollow offset pin and the seat member in the selectable orientation.

4. A boom assembly of a work vehicle as recited in claim 1, wherein the surface of the offset pin is a tapered portion, and the seat of the seat member is constructed to engage the tapered portion.

5. A work vehicle as recited in claim 2, wherein the surface of the offset pin is a tapered portion, and the seat of the seat member is constructed to engage the tapered portion.

6. A work vehicle as recited in claim 3, wherein the surface of the offset pin is a tapered portion, and the seat of the seat member is constructed to engage the tapered portion.

7. A work vehicle as recited in claim 2, wherein each boom assembly comprises an offset connection assembly.

8. A work vehicle as recited in claim 3, wherein each boom assembly comprises an offset connection assembly.

9. A work vehicle as recited in claim 2, wherein the boom assembly further comprises:

a hydraulic boom cylinders corresponding to each of the right and left boom assemblies, pivotally connected at one end to the body of the vehicle and pivotally connected at another end to the triangular plate member.

10. A work vehicle as recited in claim 3, wherein the boom assembly further comprises:

a hydraulic boom cylinders corresponding to each of the right and left boom assemblies, pivotally connected at one end to the body of the vehicle and pivotally connected at another end to the triangular plate member.

11. A boom assembly according to claim 1, wherein the seat member is attached to the triangular plate member and the pin is journaled in the link member.

12. A work vehicle according to claim 2, wherein the seat member is attached to the triangular plate member and the pin is journaled in the link member.

13. A work vehicle according to claim 3, wherein the seat member is attached to the triangular plate member and the pin is journaled in the lower link member.

14. A work vehicle according to claim 9, wherein the seat member is attached to the triangular plate member and the pin is journaled in the link member.

15. A work vehicle according to claim 10, wherein the seat member is attached to the triangular plate member and the pin is journaled in the link member.

* * * * *